US005544492A

United States Patent [19]

Manz

[11] Patent Number: 5,544,492

[45] Date of Patent: Aug. 13, 1996

[54] REFRIGERANT HANDLING SYSTEM AND METHOD WITH AIR PURGE AND MULTIPLE REFRIGERANT CAPABILITIES

[75] Inventor: Kenneth W. Manz, Paulding, Ohio

[73] Assignee: SPX Corporation, Muskegon, Mich.

[21] Appl. No.: 463,709

[22] Filed: Jun. 5, 1995

[51] Int. Cl.[6] ..... F25B 47/00

[52] U.S. Cl. ..... 62/85; 62/195; 62/475; 62/292

[58] Field of Search ..... 62/195, 475, 85, 62/126, 129

[56] References Cited

U.S. PATENT DOCUMENTS

| | | | |
|---|---|---|---|
| 5,005,369 | 4/1991 | Manz | 62/195 |
| 5,063,749 | 11/1991 | Manz | 62/149 |
| 5,181,391 | 1/1993 | Manz | 62/129 |
| 5,231,842 | 8/1993 | Manz | 62/77 |
| 5,285,647 | 2/1994 | Manz | 62/127 |

OTHER PUBLICATIONS

Manz, "How to Handle Multiple Refrigerants in Recovery and Recycling Equipment," *ASHRAE Journal,* Apr. 1991, pp. 22–30.

Manz, *The Challenge of Recycling Refrigerants,* 1995, Chapter 6.

*Primary Examiner*—John M. Sollecito

*Attorney, Agent, or Firm*—Barnes, Kisselle, Raisch, Choate, Whittemore & Hulbert

[57] ABSTRACT

A refrigerant handling system that includes a chamber for holding refrigerant, and a refrigerant pump for directing refrigerant into the chamber so that the refrigerant collects in liquid phase at a lower portion of the chamber while air and other non-condensibles collect in vapor phase at the upper portion of the chamber over the refrigerant. Sensors are responsive to temperatures of the refrigerant entering the chamber and of the refrigerant collected in the lower portion of the chamber. Partial pressure of non-condensibles in the upper portion of the chamber is determined as a function of a difference between such temperatures, and the non-condensibles are purged from the upper portion of the chamber when such partial pressure reaches a selected threshold.

12 Claims, 2 Drawing Sheets

REFRIGERANT HANDLING SYSTEM AND METHOD WITH AIR PURGE AND MULTIPLE REFRIGERANT CAPABILITIES

The present invention is directed to refrigerant handling systems and methods, and more particularly to purging of air and other non-condensibles from multiple types of refrigerants.

BACKGROUND AND SUMMARY OF THE INVENTION

In the art of refrigerant handling, there is often a need for purging air or other non-condensibles from refrigerant in the refrigerant handling system. U.S. Pat. No. 5,005,369 discloses a system for recovering refrigerant from refrigeration equipment under service with automatic or manual air purge capabilities. This system has enjoyed great commercial acceptance and success for both R-12 and R-134a refrigerant recovery/recycling units in the automotive air conditioner service market. However, the trend in the market, particularly the automotive service market, is toward single service systems that can handle multiple refrigerants. U.S. Pat. Nos. 5,063,749 and 5,181,391 disclose manual purge systems for multiple-refrigerant handling systems, and U.S. Pat. No. 5,285,647 discloses an automatic purge control for a multiple-refrigerant handling system. See also Manz, "How to Handle Multiple Refrigerants in Recovery and Recycling Equipment," ASHRAE Journal, April 1991, pages 22–30, and Manz, *The Challenge of Recycling Refrigerants,* Business News Publishing, 1995, Chapter 6.

Although the purge control techniques disclosed in the noted patents and publications have enjoyed commercial success and addressed problems theretofore extant in the art, further improvements remain desirable. In particular, there is a need in the art for an automatic purge control technique for use in refrigerant handling systems, particularly refrigerant recovery systems, that are intended and adapted for use in conjunction with multiple differing types of refrigerants having differing pressure/temperature characteristics. It is general object of the present invention to provide a refrigerant handling system and method that address this need in the art.

A refrigerant handling system in accordance with the present invention includes a chamber for holding refrigerant, and a refrigerant pump for directing refrigerant into the chamber so that the refrigerant collects in liquid phase at a lower portion of the chamber while air and other non-condensibles collect in vapor phase at the upper portion of the chamber over the refrigerant. Sensors are responsive to temperatures of the refrigerant entering the chamber and of the refrigerant collected in the lower portion of the chamber. Partial pressure of non-condensibles in the upper portion of the chamber is determined as a function of a difference between such temperatures, and the non-condensibles are purged from the upper portion of the chamber when such partial pressure reaches a selected threshold.

In the preferred embodiments of the invention, the temperature sensors take the form of refrigerant bulbs. A first refrigerant bulb containing refrigerant of preselected type is disposed in heat transferred relationship to refrigerant entering the chamber so that vapor pressure of refrigerant in the first bulb varies as a function of temperature of refrigerant entering the chamber. A second refrigerant bulb containing refrigerant of a second predetermined type, preferably the same refrigerant as in the first bulb, is disposed in heat transferred relationship to refrigerant collected in liquid phase at the lower portion of the chamber so that vapor pressure of refrigerant in the second bulb varies as a function of temperature of refrigerant in the lower portion of the chamber. A purge valve is coupled to the upper portion of the chamber. The valve has a valve element, a spring for urging the valve element to a closed position, and a diaphragm responsive to a pressure differential in combination with the spring for a controlling position of the valve element. The first and second bulbs are connected on opposite sides of the diaphragm in such a way that vapor pressure of refrigerant in the first bulb tends to open the valve element and vapor pressure of refrigerant in the second bulb tends to close the valve element. Thus, when the force of vapor pressure of refrigerant in the first bulb exceeds the sum of the force of vapor pressure in the second bulb plus pressure applied by the spring, the valve element opens to purge non-condensible from within the refrigerant holding chamber.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
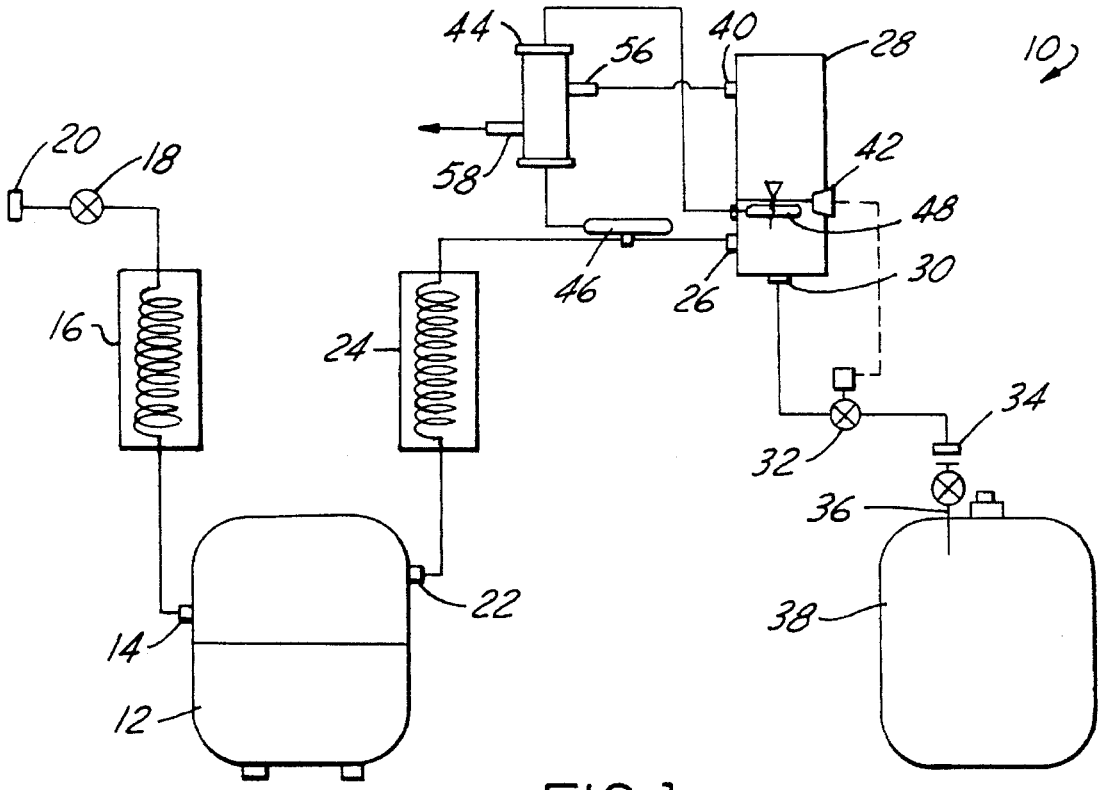
FIG. 1 is a schematic diagram of a refrigerant recovery system with air purge capabilities in accordance with one presently preferred embodiment of the invention.

FIG. 1 illustrates a refrigerant recovery system 10 in accordance with one presently preferred embodiment of the invention as comprising a refrigerant compressor 12 having an inlet 14 connected through an evaporator or accumulator 16 and a valve 18 to an inlet fitting 20 for connection to refrigeration equipment under service. Compressor 12 also has an outlet 22 connected to a condenser 24 for at least partially condensing refrigerant passing therethrough. The outlet of condenser 24 is connected to the inlet 26 of an air purge chamber 28. Chamber 28 is of generally closed construction, having refrigerant inlet 26 connected to condenser 24 as described, and a refrigerant outlet 30 at the lower portion thereof connected through a solenoid valve 32 and a fitting 34 to the vapor port 36 of a refrigerant storage container 38. Air purge chamber 28 also has a purge port 40 disposed at the upper portion thereof, and a liquid refrigerant level sensor 42 connected to solenoid valve 32 for controlling the level of refrigerant within the air purge chamber.

To the extent thus far described, refrigerant recovery system 10 is similar to that disclosed in U.S. Pat. No. 5,367,886 noted above. Inlet fitting 20 is connected to refrigeration equipment under service. When compressor 12 is activated, refrigerant is withdrawn from the equipment under service, and fed through condenser 24 to air purge chamber 28. Refrigerant collects in liquid phase at the lower portion of chamber 28, and air and other non-condensibles (as well as some refrigerant vapor) is trapped in the upper portion of chamber 28 over the collected liquid refrigerant. When the liquid refrigerant within chamber 28 exceeds a level below sensor 42, sensor 42 opens valve 32 and drains refrigerant into storage container 38. When the liquid refrigerant level returns to the level of sensor 42, valve 30 is closed.

Figure 3:
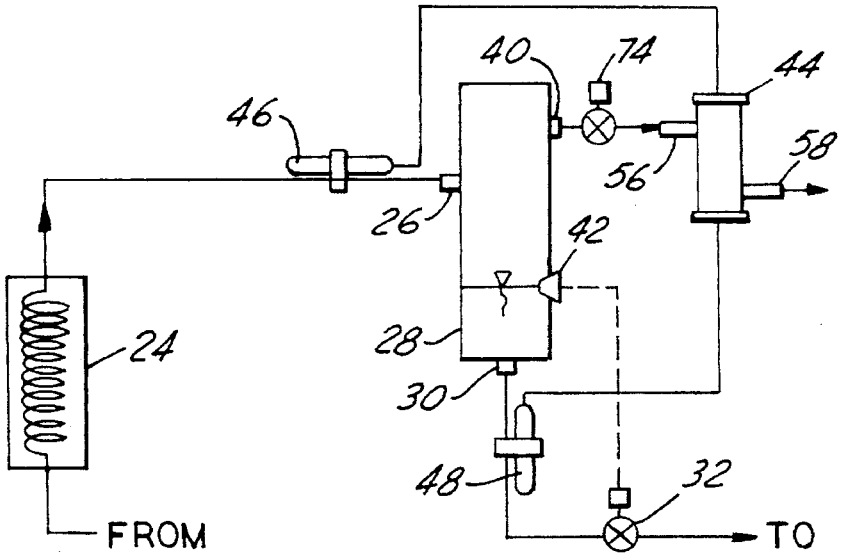
FIG. 3 is a fragmentary schematic diagram that illustrates a modification to the embodiment of FIG. 1.

In accordance with the present invention, the purging of air and other non-condensibles from chamber 28 is controlled by a valve 44, and a pair of refrigerant bulbs 46, 48 that control operation of valve 44. Refrigerant bulb 46 is coupled to the refrigerant line connected to chamber inlet 26 in such a way as to be responsive to the temperature of refrigerant entering chamber 28 from condenser 24. Bulb 48 is operatively coupled to chamber 28 in such a way as to be responsive to the temperature of the refrigerant collected in liquid phase at the lower portion of chamber 28. This may be accomplished by positioning bulb 48 within chamber 28 beneath the level of sensor 42 as illustrated in FIG. 1, or positioning bulb 48 lower within chamber 28, or affixing bulb 48 clamped to chamber 28 external to the lower portion thereof, or clamping bulb 48 to the outlet line directed solenoid valve 32 as illustrated in FIG. 3.

Figure 4:
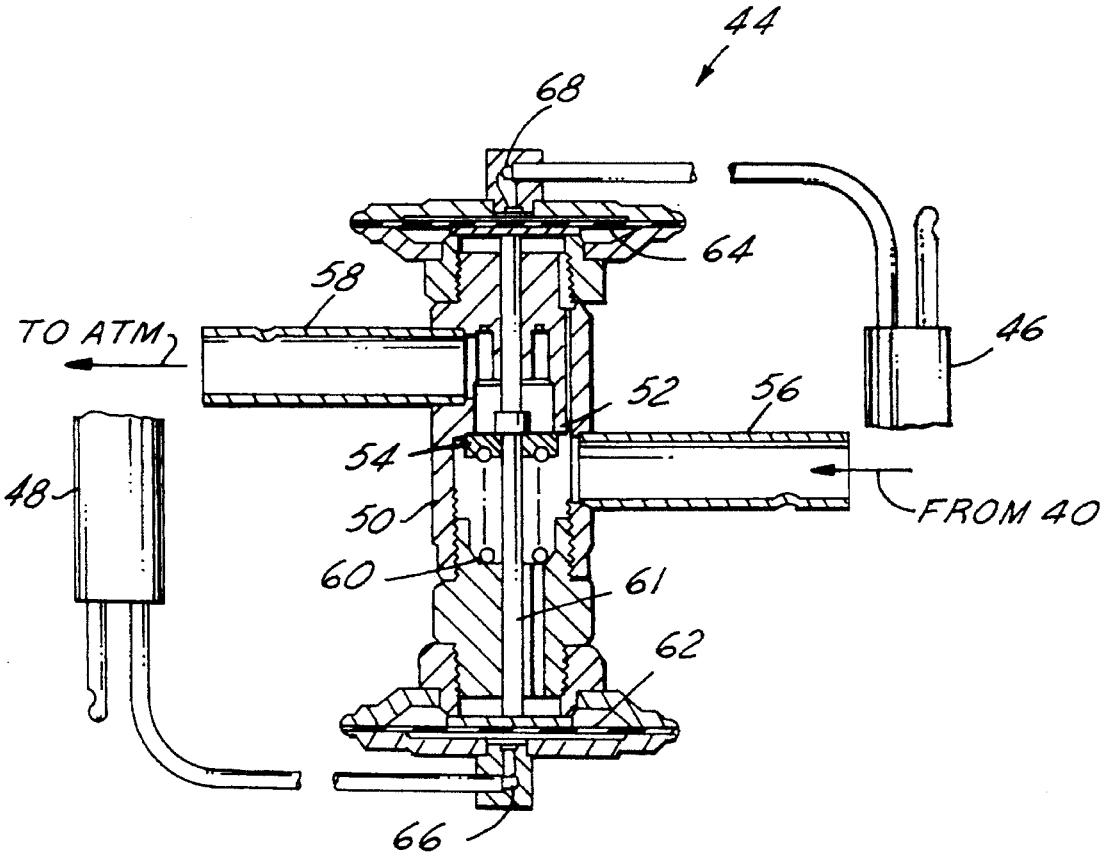
FIG. 4 is a fragmentary sectional view of the purge control valve illustrated schematically in FIGS. 1 and 3.

As shown in FIG. 4, valve 44 comprises a valve body 50 having a valve seat 52 and a valve element 54 moveable against and away from seat 52. A valve inlet fitting 56 is coupled to purge port 40 of chamber 28 (FIG. 1) for feeding air and other non-condensibles from the upper portion of chamber 28 to one side of valve element 54. A valve outlet fitting 58 feeds air and other non-condensibles to atmosphere or to other downstream non-condensible purge components. A coil spring 60 is captured in compression within valve body 50, and urges element 54 toward a closed position against seat 52. Element 54 is coupled by a shaft 61 to a pair of axially opposed diaphragms 62, 64 captured in respective axillary opposed diaphragm chambers. The outer sides of the diaphragm chambers are coupled to valve pressure input control ports 66, 68 respectively. Ports 66, 68 are respectively connected to bulbs 48, 46. Valve 44 is similar to that disclosed in U.S. Pat. No. 5,231,842 for controlling flow of refrigerant through evaporator 16 (FIG. 1).

Figure 2:
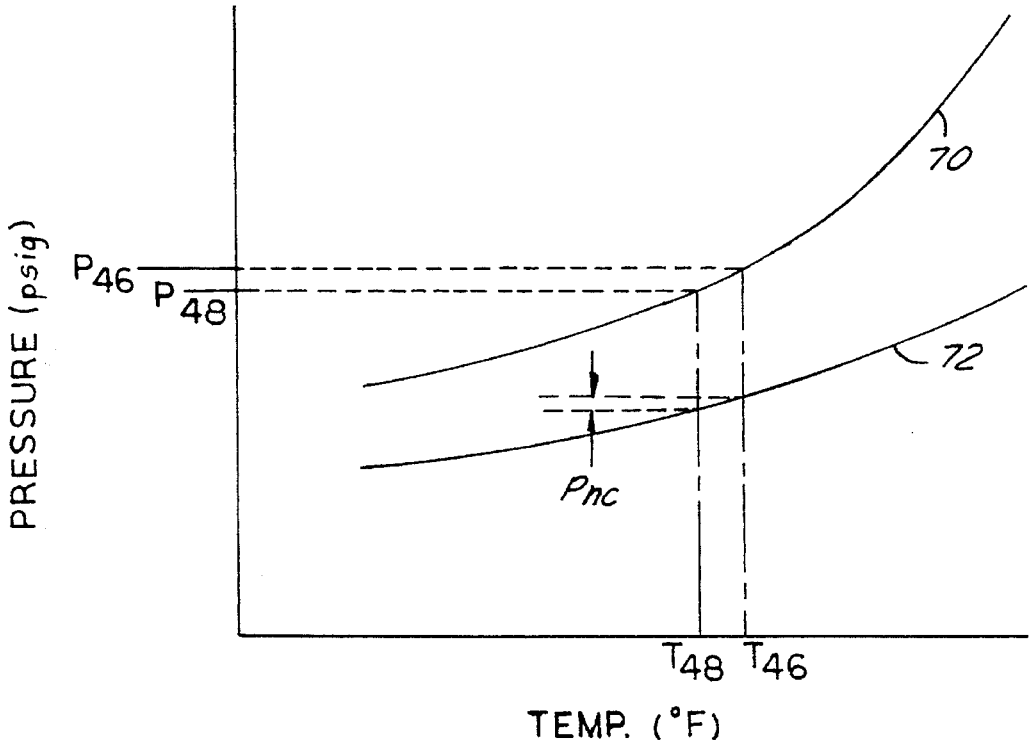
FIG. 2 is a graphic illustration that assists explanation of operation of the invention.

Operation of the air purge control of the present invention is graphically illustrated in FIG. 2. The total vapor pressure at the upper portion of chamber 28 is equal to the partial pressure of air and other non-condensibles trapped within the air purge chamber, plus the partial pressure of any refrigerant vapor in the upper portion of the air purge chamber. The effect of non-condensible partial pressure in the upper portion of chamber 28 is to increase the condensing temperature by an equivalent amount. Therefore, the liquid phase refrigerant in the lower portion of the purge chamber is below saturation temperature when non-condensibles are present in the upper portion of the chamber. Inlet pressure of refrigerant from condenser 24 is equal to the total vapor pressure in the upper portion of chamber 28. Therefore, the temperature differential between the refrigerant entering chamber 28 through inlet 26 and the liquid phase refrigerant in the lower portion of chamber 28 is a measure of the partial pressure of non-condensibles trapped within the upper portion of chamber 28.

This relationship is illustrated in FIG. 2, which graphically illustrates vapor pressure in psig versus temperature in °F. Curve 70 is the pressure/temperature saturation curve for the refrigerant within bulbs 46, 48, which preferably is the same refrigerant as noted above. Curve 72 is the pressure/temperature saturation curve of the refrigerant flowing through system 10. For the particular situation illustrated in phantom lines, bulb 46 is at temperature $T_{46}$ and bulb 48 is at temperature $T_{48}$. These temperature correspond to bulb refrigerant partial pressures of $P_{46}$ and $P_{48}$ respectively. It will also be noted at refrigerant saturation curve 72, that the temperature differential $T_{46}$–$T_{48}$ reflects a pressure difference Pnc, which is the partial pressure of air and other non-condensibles in the upper portion of chamber 28. When this partial pressure exceeds the force of spring 60 (FIG. 4)—i.e., when the partial pressure of refrigerant within bulb 46 exceeds the sum of the partial pressure of refrigerant within bulb 48 plus the force of spring 60 on valve element 62—valve 44 opens and the upper portion of purge chamber 28 is vented to atmosphere or other purge components.

Spring 60 thus determines the threshold partial pressure of non-condensibles within chamber 28 at which valve 44 will open. This spring force can be set for differing desired purge pressures. It will also be noted that this non-condensible partial pressure at which purge will automatically occur is independent of refrigerant type. That is, use of a different refrigerant within system 10, having a differing pressure/temperature saturation curve 72, will still yield operation as described above, with non-condensibles being purged from chamber 28 at the same non-condensible partial pressure Pnc as illustrated in FIG. 2. Thus, refrigerant handling system 10 can be used with multiple differing types of refrigerants without further adjustment to valve 44.

FIG. 3 illustrates a modified embodiment of the invention, in which referrence numerals identical to those in FIG. 1 indicate identical components. Refrigerant bulb 48 is disposed outside of air purge chamber 28 externally clamped to a conduit in the refrigerant flow path between chamber outlet 30 and solenoid valve 32. However, bulb 48 is still responsive to temperature of refrigerant captured within the lower portion of chamber 28, which refrigerant also extends into the conduit to solenoid valve 32. A second solenoid valve 74 is connected between chamber purge port 40 and purge control valve 44. The function of solenoid valve 74 is to permit control of the timing of the non-condensibles purge operation by system controlled electronics (not shown).

What is claimed is:

1. A method of purging non-condensibles from refrigerant comprising the steps of:

(a) directing the refrigerant into a chamber such that the refrigerant collects in liquid phase at a lower portion of said chamber and non-condensibles are trapped in an upper portion of said chamber over the liquid refrigerant, (b) measuring temperatures of the refrigerant entering said chamber and of said collected refrigerant, (c) determining partial pressure of non-condensibles in said upper portion of said chamber as a function of a difference between said temperatures measured in said step (b), and (d) purging non-condensibles from said upper portion of said chamber when said partial pressure determined in said step (c) reaches a selected threshold.

2. The method set forth in claim 1 wherein said refrigerant is directed in said step (a) into said upper portion of said chamber.

3. The method set forth in claim 1 wherein said step (b) is accomplished by:

(b1) positioning a first refrigerant bulb containing a first predetermined type of refrigerant in heat transfer relationship with refrigerant entering said chamber so that vapor pressure of said first refrigerant in said first bulb varies as a function of temperature of refrigerant entering said chamber, and (b2) positioning a second refrigerant bulb containing a second predetermined type of refrigerant in heat transfer relationship with the collected refrigerant in liquid phase so that vapor pressure of said second refrigerant in said second bulb varies as a function of temperature of said collected liquid phase refrigerant.

4. The method set forth in claim 3 wherein said step (c) comprises the steps of:

(c1) connecting to said upper portion of said chamber a valve having a valve element, spring means urging said valve element to a closed position, and means responsive to a pressure differential in combination with said spring means for controlling position of said valve element, and (c2) connecting said first and second bulbs on opposite sides of said means responsive to said pressure differential in such a way that vapor pressure of said first refrigerant in said first bulb tends to open said valve element and vapor pressure of said second refrigerant in said second bulb tends to close said valve element.

5. The method set forth in claim 4 wherein said first and second refrigerants are the same.

6. The method set forth in claim 5 comprising the additional step of: (e) setting said threshold as a function of said spring means.

7. The method set forth in claim 6 comprising the additional step of: (f) directing refrigerants having differing temperature/pressure characteristics into said chamber in said step (a), said valve and bulbs cooperating automatically to purge non-condensibles from said upper portion of said chamber when said partial pressure of non-condensibles determined in said step (c) reaches said threshold, determined at least in part by said spring means, independent of the pressure/temperature characteristics of the refrigerant directed into said chamber.

8. In a refrigerant handling system that includes a closed chamber for holding refrigerant and means for directing refrigerant into said chamber such that the refrigerant collects in liquid phase at a lower position of said chamber and non-condensibles collect at an upper position of said chamber over the refrigerant, means for purging non-condensibles from said upper portion of said chamber comprising:

a first refrigerant bulb containing refrigerant of preselected type disposed in heat transfer relationship to refrigerant entering said chamber so that vapor pressure of refrigerant in said first bulb varies as a function of temperature of refrigerant entering said chambers, a second refrigerant bulb containing refrigerant of the same said preselected type disposed in heat transfer relationship to refrigerant collected in said lower portion of said chamber so that vapor pressure of refrigerant in second bulb varies as a function of temperature of refrigerant in said lower portion of said chamber, and a valve operatively coupled to said first and second bulbs and positioned automatically to purge non-condensibles from said upper portion of said chamber as a function of a difference between refrigerant vapor pressures in said first and second bulbs so as to vent non-condensibles from said chamber at a preselected partial pressure of non-condensibles within said chamber independent of pressure/temperature characteristics of the refrigerant in said chamber such that said system is adapted to be employed for handling refrigerants of such differing pressure/temperature characteristics.

9. The system set forth in claim 8 wherein said valve comprises a valve seat, a valve element positioned to engage said seat, spring means urging said element against said seat, and means for moving said element off of said seat when force on said element due to said pressure difference exceeds force on said element from said spring means.

10. A refrigerant handling system that includes:

a closed chamber for holding refrigerant, means for directing refrigerant into said chamber such that the refrigerant collects in liquid phase at a lower portion of said chamber and non-condensibles are trapped in an upper portion of said chamber over the liquid refrigerant, means for measuring temperatures of the refrigerant entering said chamber and of said collected refrigerant, means for determining partial pressure of non-condensibles in said upper portion of said chamber as a function of a difference between said temperatures, and means for purging non-condensibles from said upper portion of said chamber when said partial pressure reaches a selected threshold.

11. The system set forth in claim 10 wherein said measuring means comprises:

a first refrigerant bulb containing a first predetermined type of refrigerant in heat transfer relationship with refrigerant entering said chamber so that vapor pressure of said first refrigerant in said first bulb varies as a function of temperature of refrigerant entering said chamber, and a second refrigerant bulb containing the same said predetermined type of refrigerant in heat transfer relationship with collected refrigerant in liquid phase so that vapor pressure of said second refrigerant in said second bulb varies as a function of temperature of said collected liquid phase refrigerant.

12. The system set forth in claim 11 wherein said means for determining partial pressure comprises:

a valve having a valve element, spring means urging said valve element to a closed position, and means responsive to said pressure difference in combination with said spring means for controlling position of said valve element, said first and second bulbs being connected on opposite sides of said means responsive to said pressure difference in such a way that vapor pressure of said first refrigerant in said first bulb tends to open said valve element and vapor pressure of said second refrigerant in said second bulb tends to close said valve element.

* * * * *